United States Patent [19]

Krebs et al.

[11] 3,942,071

[45] Mar. 2, 1976

[54] GAS-DISCHARGE DISPLAY DEVICE DRIVING CIRCUITS

[75] Inventors: Peter Eric Krebs, Hale; Frank Walters, Bury, both of England

[73] Assignee: Ferranti, Limited, Hollinwood, England

[22] Filed: Nov. 1, 1974

[21] Appl. No.: 520,343

[30] Foreign Application Priority Data

Nov. 3, 1973 United Kingdom ..... 51132/73

[52] U.S. Cl. ..... 315/169 TV; 340/166 EL

[51] Int. Cl.[2] ..... G09F 13/22; H05B 33/00

[58] Field of Search ..... 315/169 TV, 166, 169 R; 340/166 R, 166 EL

[56] References Cited

UNITED STATES PATENTS

| | | | |
|---|---|---|---|
| 3,708,717 | 1/1973 | Fleming | 315/169 TV |
| 3,742,483 | 6/1973 | Ogle | 315/169 TV X |
| 3,809,952 | 5/1974 | Eisenberg et al. | 315/169 TV |

*Primary Examiner*—Siegfried H. Grimm

*Attorney, Agent, or Firm*—Cameron, Kerkam, Sutton, Stowell & Stowell

[57] ABSTRACT

A driving circuit arrangement for a gas-discharge display device consisting of an array of discharge lamps applies to the array a discharge retaining voltage composed of a voltage less than is required to maintain a discharge and a voltage equal to the magnitude of a 'half-pulse,' the use of two coincident half-pulses being sufficient in addition to the retaining voltage to strike a discharge. To extinguish a discharge in one or more of the lamps the voltage equal to a half-pulse is removed temporarily from one of the conductors associated with the lamp, thereby reducing the voltage across all the lamps connected to that conductor below the level required to retain a discharge, and a compensating voltage of magnitude equal to a half-pulse is temporarily applied to the other conductor of those lamps in which it is desired that the discharge not be extinguished.

12 Claims, 2 Drawing Figures

Figures 1, 2:
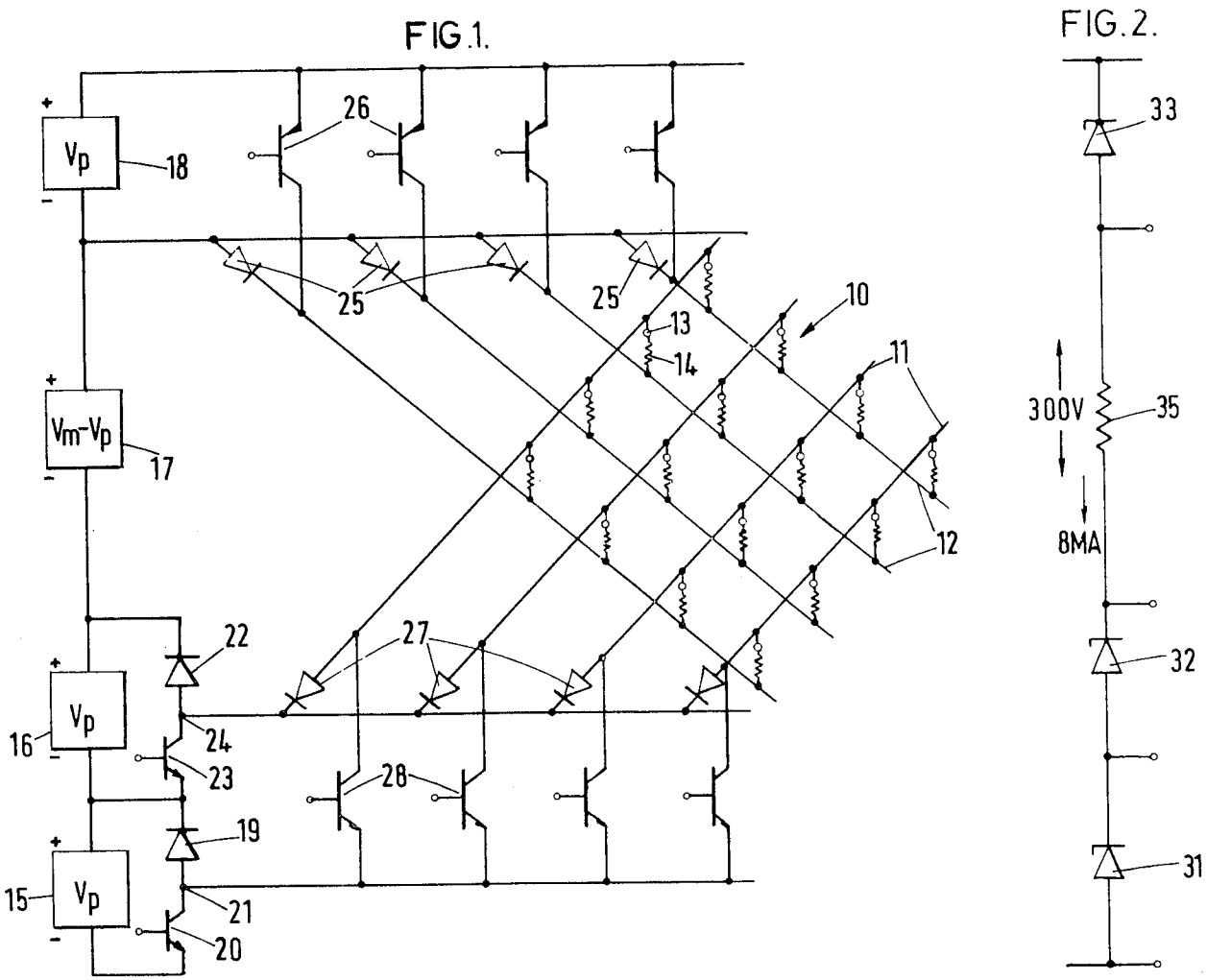

10
11
12
13
14
15
16
17
18
19
20
21
22
23
24
25
26
27
28
31
32
33
35
300V
8MA
Vp
Vm-Vp

GAS-DISCHARGE DISPLAY DEVICE DRIVING CIRCUITS

This invention relates to driving circuit arrangements for gas-discharge display devices.

Gas-discharge display devices are well known in which discharges are struck in selected ones of a two co-ordinate array of direct current gas-discharge lamps to form a display. Individual conductors of a set of anode conductors interconnect the anodes of the discharge lamps extending along different values of one co-ordinate of the array and individual conductors of a set of cathode conductors interconnect the cathodes of the lamps extending along different values of the other co-ordinate of the array.

Such display devices have memories in that by the application of a discharge retaining voltage across all of the anode and cathode conductors, selected lamps, lit by the application of voltage pulses of the correct magnitude and sense to selected anode and cathode conductors to raise the voltage applied to them above the level required to strike a discharge can have a discharge retained therein by the retaining voltage at a lower level than that required to strike the discharge. The discharges are retained without any need to 'refresh' them until it is desired to extinguish some or all of them by reducing the voltage across relevant lamps below the discharge maintaining level by means of appropriate pulses. Such a gas-discharge display device will hereinafter be called "of the kind referred to." In discharge display devices of the kind referred to the voltage pulses applied to the anode and cathode conductors to strike or extinguish a discharge are each required to be of a magnitude insufficient by itself to cause a discharge to strike or extinguish but in combination are sufficient to provide the magnitude. These pulses are hereinafter referred to as half-pulses.

It is an object of the present invention to provide a driving circuit arrangement for a gas-discharge display device of the kind referred to, of simple and novel construction.

According to the present invention a driving circuit arrangement for a gas-discharge display device of the type referred to comprises means for applying across all of the discharge lamps a retaining voltage of insufficient magnitude to initiate a discharge in any lamp but of sufficient magnitude to maintain a discharge, primary switching means operable to apply to a conductor associated with one co-ordinate of the device an extinguishing pulse of magnitude and sense to reduce the retaining potential difference across the lamps associated with that conductor below the level required to retain a discharge therein and compensatory switching means operable simultaneously with the primary switching means to apply a compensatory pulse, equal in magnitude to the extinguishing pulse but of opposite sense, to selected ones of the conductors associated with the other co-ordinate of the array to cause discharges in the lamps associated therewith and common to both conductors to be retained.

Also according to the present invention a driving circuit arrangement as defined in the preceding paragraph may comprise a source of a first potential, first switching means operable to connect selected individual anode conductors to the source of the first potential, a source of second potential lower than the first, the potential difference between them being equal to the magnitude of a half-pulse (as herein defined), first coupling means arranged to connect all of the anode conductors individually to the source of second potential, a source of third potential, lower than the second, the potential difference between the second and third potentials being equal to the difference between the discharge retaining and half-pulse voltages, a source of fourth potential lower than the third by the magnitude of a half-pulse, second switching means, second coupling means arranged to connect all of the cathode conductors individually to the second switching means, said second switching means being operable to connect all of the cathode conductors either to the source of third potential or to the source of the fourth potential, a source of fifth potential lower than the fourth by the magnitude of the half-pulse, third switching means operable when the cathode conductors are connected (by way of the second switching means) to the source of the fourth potential, to connect selected individual cathode conductors to the source of the fifth potential and operable, when the cathode conductors are connected (by way of the second switching means) to the source of third potential, to connect selected individual cathode conductors to the source of the fourth potential.

The invention will now be described by way of example with reference to the accompanying drawings, in which:

FIG. 1 is a schematic circuit arrangement of part of a d.c. gas-discharge display panel and the driving means for that part, and FIG. 2 is one form of power supply for the circuit arrangement of FIG. 1.

Referring to FIG. 1 a direct current gas-discharge panel 10 comprises a cross-bar arrangement of cathode conductors 11 and anode conductors 12 forming the rows and columns respectively of a rectangular matrix. At each cross-over point between conductors of the two sets a discharge lamp 13 and current limiting resistor 14 extend between the two conductors. Any one of the discharge lamps is illuminated by applying potentials of appropriate magnitude to the relevant anode and cathode conductors associated with it such that the lamp at the uniquely defined intersection has a potential difference, equal at least to its striking voltage, applied across it, whereas other lamps common to either one of the conductors have only part of the necessary striking potential difference and are not caused to strike. Once a discharge is struck it may be maintained by a retaining potential difference less than that required to strike a discharge initially.

In large cross-bar arrays it is usual for potentials to be applied to all of the anode and cathode conductors such that a retaining voltage ($V_M$) is present across all of the lamps of the array. In order to strike a discharge in any one lamp, that is, to raise the potential difference across it to the striking voltage ($V_s$), the appropriate anode conductor is raised in potential by a positive going pulse of magnitude $\frac{1}{2}(V_s - V_M)$ and the appropriate cathode conductor is reduced in potential by a negative going pulse of the same magnitude both superimposed on the retaining voltage such that the necessary striking voltage $V_s$ appears across the selected lamp. The maximum voltage appearing across other lamps connected to the same conductors is $V_M + \frac{1}{2}(V_s - V_M)$ which is equal to $\frac{1}{2}(V_s + V_M)$ and, as $V_M < V_s$, this is less than $V_s$ and a discharge does not strike in these lamps.

In order to produce a complete display, the anode conductors are raised in potential one at a time by a pulse and as each one is raised selected cathode conductors are reduced in potential for the pulse period and lamps at the intersections are lit, the procedure being repeated for each anode conductor until the display is completed.

In selectively erasing such a display the potential difference across a lamp to be extinguished has to be reduced to below the level at which a discharge can be maintained, again by co-ordinate application of pulses, opposite in polarity to those for striking a discharge, to the appropriate anode and cathode conductors; the magnitudes of the retaining voltage and of the extinguishing pulses are chosen such that a single pulse is insufficient to extinguish a discharge in a lamp common to either conductor.

In large arrays of discharge lamps a large number of driving transistors are required to effect the switching of potentials described above and depending on the number of levels to which a particular conductor has to be switched several transistors may be required. In a compact form of display device such as that described in U.S. Pat. Nos. 3,603,837 and 3,735,183 driving circuitry of discrete components may be unacceptably bulky in relation to the array and will almost certainly be expensive to produce both in terms of component cost and assembly time. The use of transistor switches produced in the form of monolithic integrated circuits is not always possible because of the relatively high voltages employed in display devices of this form. Typically the striking voltage $V_s = 300$ volts and the retaining voltage $V_M = 200$ volts, the voltage pulses being applied to cause striking and extinguishing being about 50 volts in amplitude. Thus transistors used as switches may have to withstand 100 volts, when switched OFF, between, say, the striking level of $(V_M + 50)$ volts to which it switches the conductor during writing and $(V_M - 50)$ volts to which the conductor may fall during erasure. Such voltage swings are not desirable in transistors of monolithic integrated circuit form and the complete display device suffers for this drawback.

The driving circuit arrangement according to the present invention overcomes this drawback and is shown in FIG. 1 comprising four series connected voltage sources 15, 16, 17 and 18. Each of the sources 15, 16 and 18 produce a half-pulse voltage $V_p$ and the source 17 produces a voltage $(V_M - V_p)$, where $V_M$ is the discharge retaining voltage for all of the discharges and $V_M - V_p$ is the voltage sufficiently below the minimum maintaining voltage to cause a discharge to be extinguished. $V_s$ is the striking voltage such that $V_s = (V_M + 2V_p)$.

A series combination of a diode 19 and a transistor switch 20 shunt the source 15 and are connected such that a current path exists between a point 21, at the junction of the diode and transistor switch, either to the positive side of the source 15, by way of the diode 19, or to the negative side of the source 15, by way of the transistor switch 20, depending on whether the transistor is turned OFF or ON.

A similar switch system (comprising second switching means) shunts the source 16 and comprises a diode 22, transistor switch 23 and a junction point 24.

All of the anode conductors 12 of the display are connected individually to the positive side of the source 17, to a second potential, by way of first coupling means, diodes 25. Each anode conductor is also connected by way of a transistor switch 26 forming first switching means to the positive side of source 18 (a first potential). The diodes 25 prevent the source 18 from being short-circuited for all conductors on operation of any single transistor switch 26 and isolate the conductors from each other. The cathode conductors 11 are connected individually to the point 24 by way of diodes 27. Each of the cathode conductors is also connected by way of a transistor switch 28 to the point 21. The switches 28 combined with the switch 20 comprise third switching means.

Under display, or storage, conditions when information is not being written or erased the anode conductors are connected to the source of second potential, the positive side of source 17, and the transistor switch 23 is ON so that the point 24, and therefore the cathode conductors, are effectively connected to the negative side of the source 16 (a third potential). Thus a retaining voltage $(V_M - V_p) + V_p = V_M$ exists across all of the lamps of the array.

In order to write information on to the display, the display is put into a WRITE condition in which the transistor switch 20 is turned ON as well as the transistor switch 23. The retaining voltage $V_M$ still appears across the array of lamps. Each of the anode conductors is raised in turn to the potential of the positive side of the source 18 by sequential pulsing of the switches 26. As each transistor switch 26 is turned ON selected ones of the transistor switches 28 are turned ON for the pulse duration such that the cathode conductors are connected by way of the transistor switches 28 to the negative side of the source 15, (a fifth potential) that is, the selected lamps have a voltage $[(V_M - V_p) + V_p] + V_p + V_p = V_M + 2\,V_p$, the striking voltage, across them. All the other lamps connected to one only of the anode or selected cathode conductors have a maximum voltage across them of $[(V_M - V_p) + V_p] + V_p = V_M + V_p$, insufficient to strike a discharge. After the pulses have been removed, the voltage $(V_M - V_p) + V_p = V_M$ retains all discharges struck. The procedure is repeated for each anode conductor in turn until the display is completed. After the WRITE sequence has been commpleted the transistor switch 23 is retained in the ON state and the transistor switch 20 may be turned OFF or left ON; conveniently it may be left in the condition in which it was last placed.

To erase a complete display the transistor switch 23 is merely turned OFF connecting the point 24 to the positive side of the source 16 (a second potential) and the retaining voltage is reduced to $V_M - V_p$, insufficient to maintain any discharges. To selectively extinguish discharges of a display this may be done row-by-row or column-by-column. In row-by-row erasure the transistor switches 20 and 23 are both turned OFF, simultaneously with all of the transistor switches 26 being turned ON. The retaining voltage across all of the lamps is still $(V_M - V_p) + V_p$ but this is now derived from the sources 17 and 18 instead of sources 17 and 16.

The transistor switches 26 are pulsed OFF one at a time in sequence and comprise the primary switching means. As each transistor switch 26 is turned OFF and the anode conductor 12 is reduced to the second potential, providing an extinguishing pulse to the device, transistor switches 28 are turned ON such that the cathode conductors concerned are connected by way of diode 19 to the source of fourth potential (negative side of the source 16), to provide a compensating pulse. The transistor switches 28 thus comprise the compensatory switching means. The transistor switches 28 for the cathode conductors of the lamps which are to be extinguished remain, or are turned, OFF and these cathode conductors are connected by way of the diode 22 to the source of third potential (negative side of the source 17) resulting in a voltage $(V_M - V_p)$ appearing across the selected lamps; this is insufficient to maintain a discharge and they are extinguished. At the end of the pulse, the transistor switch 26 is turned ON and the switches 28 are turned OFF. This procedure is repeated as each transistor switch 26 is pulsed OFF in turn. At the end of the ERASE sequence the transistor switches 26 are all turned OFF simultaneously with the transistor switch 23 being turned ON, the retaining voltage remaining at a constant value but again being derived from the source 16 and 17. The transistor switch 20 can be left OFF until required for a subsequent WRITE sequence.

In column-by-column erasure the transistor switch 23 is turned OFF and all of the transistor switches 28 are turned ON. The transistor switch 20 is turned OFF so that the cathode conductors 11 are still connected to the source of fourth potential but by way of the transistor switches 28 and the diode 19 instead of the transistor switch 23.

The first transistor switch 28 is turned OFF by the application of an extinguishing pulse, thereby increasing the potential on the cathode conductor 11 which is connected to the source of third potential by way of diodes 27 and 22; the potential difference appearing across the lamps associated with the conductor is reduced to $V_M - V_p$ (from the source 17) and compensating pulses are applied to selected ones of the anode conductors 12 by turning ON the associated transistor switches 26 and temporarily connecting the selected anode conductors to the source of first potential to maintain the potential difference of $(V_M - V_p) + V_p = V_M$ across them. The transistor switches 26 are turned OFF as the first transistor switch 28 is turned ON. The second of the switches 28 is then pulsed OFF as selected transistor switches 26 associated with the discharges it is desired to retain are turned ON. This is repeated for each column (cathode) conductor in turn.

In writing alphanumeric characters which require a 7 × 5 block of lamps for each character an alternative form of writing comprises striking discharges in all 35 lamps of the block and erasing those which are not required for the particular character, thereby forming the display one character or column of characters at a time.

In forming one such character the switches 20 and 23 are turned ON, and the first five transistor switches 26 are all pulsed ON simultaneously with the first seven transistor switches 28 forming a block of discharges which are retained after the pulses are removed. The switches 20 and 23 are then turned OFF as all the transistor switches 26 are turned ON thus receiving the retaining voltage from the sources 17 and 18. Then each of the five transistor switches 26 is pulsed OFF in turn; as each one is turned off the transistor switches 28 relating to the discharges which are to be retained are pulsed ON such that the retaining voltage is contained across these lamps and the remainder associated with that anode are extinguished. When the five transistor switches 26 have been pulsed OFF and returned to the ON position, the switches 20 and 23 are turned ON as all of the transistor switches 26 are turned OFF so that the required discharges forming the character are retained.

The next block of 35 discharges are struck between the seventh to 11th anodes and the first seven cathodes by the pulsing of the appropriate transistor switches 26 and 28 and the switch 20. The column of lamps on the sixth anode are not used so as to provide a separation between the alphanumeric characters. After the striking pulses, all of the transistor switches 26 are turned ON and the switches 20 and 23 turned OFF. The switches 26 of the anodes conductors seven to 11 are then pulsed OFF one at a time as appropriate cathode switches 28 are pulsed ON to retain selected discharges. After the second character has been completed, the transistor switches 26 are all turned OFF and the switches 20 and 23 are turned ON in readiness for the next character. A correspondingly similar method of producing a display may be achieved using column-by-column erasure.

In a display involving several lines of characters all the lines can be written simultaneously from left to right as the groups of anode conductors are used to define character blocks. It may be desirable to pulse a subsequent block of lamps on and off while a character is being written on a previous block so as to provide priming for the lamps of the block when it has a character written on it.

From the foregoing it will be appreciated that the maximum voltage that can appear across the transistor switches 26 when they are turned OFF is $V_p$ from the source 18 and similarly, as the transistor switch 20 is never turned ON when the transistor switch 23 is turned OFF, the maximum voltage appearing across the transistor switches 28 is also $V_p$, whether from the source 15 or the source 16.

In a particular device, $V_M$ may be 200 volts and $V_p$ may be 45 volts with $V_s = (V_M + 2V_p) = 290$ volts and $(V_M - V_p) = 155$ volts. Because the transistor switches having only to withstand reverse voltages of 45 volts they may be formed as a monolithic semiconductor integrated circuit with resultant savings in cost and space and ease of construction of the complete display device.

The currents taken from sources 15, 16, 17, 18 are the device current and the transistor switches currents. Since the transistor switch loads are reversed bias diodes and the resistance of the lamps, the additional switching current is very low and may be obtained by a potential divider and a single source as shown in FIG. 2. This divider comprises three reference zener diodes 31, 32 and 33 in series with a resistor 35 between supply rails of a 290 to 300 volt source (not shown). The diodes all have a 45 volt breakdown and the resistor may have a value of 20 KOhm to give a current flow of 8 mAmp. The current taken by each discharge lamp is low, say 20 microAmp, under discharge retaining conditions so that hundreds of lamps can be supplied from this simple source without too great a regulating effect. The power dissipation of such a supply is also low, in the region of 7 watts.

The transistor switches 26 may be connected to a strobe circuit for scanning the anode conductors during WRITE and ERASE sequences in combination with control means for determining the state of transistor switches 20 and 23. A read-only-memory may be provided to control the transistor switches 28 in synchronism with the strobe circuit for the production of alphanumeric characters or other such displays.

The circuit arrangements as shown and described employs NPN transistors as switches and has the two sources of potential $V_p$, 15 and 16, adjacent each other at the low potential side of the supply. The arrangement may be operated in a corresponding manner with transistors of opposite conductivity type and the diodes reversed in their conducting direction, the source 16 then being placed between the sources 17 and 18. Furthermore the transistor switches 23 and 20, as they are required to be operated only when changing between write and erase modes, and can be turned ON or OFF together, may comprise mechanical switches or a single double pole double throw switch.

What we claim is:

1. A driving circuit arrangement for a gas-discharge display device of the type having a two co-ordinate array of direct current gas-discharge lamps, a set of anode conductors interconnecting the anodes of discharge lamps extending along different values of one co-ordinate of the array and a set of cathode conductors interconnecting the cathodes of the lamps extending along different values of the other co-ordinate of the array, comprising means for applying across all of the discharge lamps a retaining voltage of insufficient magnitude to initiate a discharge in any lamp but of sufficient magnitude to maintain a discharge, primary switching means operable to apply to a conductor extending along one co-ordinate of the array an extinguishing pulse of magnitude and sense to reduce the retaining potential difference across the lamps connected to that conductor below the level required to retain a discharge therein, and compensatory switching means operable simultaneously with the primary switching means to apply a compensatory pulse, equal in magnitude to the extinguishing pulse but of opposite sense, to selected ones of the conductors extending along the other co-ordinate of the array to cause discharges in the lamps connected thereto and common to both conductors to be retained.

2. A driving circuit arrangement as claimed in claim 1 wherein said primary switching means and compensatory switching means comprise a source of a first potential, first switching means operable to connect selected individual anode conductors to the source of the first potential, a source of second potential lower than the first, the potential difference between them being equal to the magnitude of a half-pulse, first coupling means arranged to connect all of the anode conductors individually to the source of second potential, a source of third potential lower than the second, the potential difference between the second and third potentials being equal to the difference between the discharge retaining and half-pulse voltages, a source of fourth potential lower than the third by the magnitude of a half-pulse, second switching means, second coupling means arranged to connect all of the cathode conductors individually to the second switching means, said second switching means being operable to connect all of the cathode conductors either to the source of third potential or to the source of the fourth potential, a source of fifth potential lower than the fourth by the magnitude of the half-pulse, third switching means operable when the cathode conductors are connected (by way of the second switching means) to the source of the fourth potential, to connect selected individual cathode conductors to the source of the fifth potential and operable, when the cathode conductors are connected (by way of the second switching means) to the source of third potential, to connect selected individual cathode conductors to the source of the fourth potential.

3. A driving circuit arrangement as claimed in claim 2 in which the first switching means comprises a plurality of transistor switches, individual switches being operable when caused to conduct to connect individual anode conductors to the source of the first potential.

4. A driving circuit arrangement as claimed in claim 2 in which the second switching means comprises a diode connected between the second coupling means and the source of third potential so as to prevent the potential of the cathode conductors from exceeding the third potential and a switch connected between the source of fourth potential and the diode, the arrangement being such that when the switch is closed the cathode conductors are connected to said source of fourth potential and when the switch is open the cathode conductors are connected to the source of third potential.

5. A driving circuit arrangement as claimed in claim 4 in which the switch is a transistor.

6. A driving circuit arrangement as claimed in claim 2 in which the third switching means comprises a diode connected to the source of fourth potential, a switch connected between the diode and the source of fifth potential and a plurality of transistor switches, individual switches being operable when caused to conduct to connect individual cathode conductors to the junction of the diode and the switch.

7. A driving circuit arrangement as claimed in claim 2 in which the first and second coupling means comprises a plurality of diodes, each individual diode being connected in series with each of the anode and cathode conductors respectively.

8. A driving circuit arrangement as claimed in claim 2 in which the sources of potential comprise serially connected voltage sources.

9. A driving circuit arrangement as claimed in claim 8 in which each voltage source comprises a portion of a potential divider chain arranged to be connected to a voltage source at least as great as the striking voltage.

10. A driving circuit arrangement as claimed in claim 9 in which the potential divider chain comprises three reverse biased voltage regulator diodes, each being operable to conduct when a voltage of magnitude not less than that of a half-pulse is applied, and a resistor, the voltage appearing across each regulator diode being equal to the magnitude of a half-pulse and the voltage appearing across the resistor being equal to the difference between the second and third potentials.

11. A driving circuit arrangement as claimed in claim 2 in which the first switching means comprises the primary switching means and the third switching means comprises the compensatory switching means.

12. A driving circuit arrangement as claimed in claim 2 in which the third switching means comprises the primary switching means and the first switching means comprises the compensatory switching means.

* * * * *